US005583548A

United States Patent [19]

Kearns

[11] Patent Number: 5,583,548

[45] Date of Patent: Dec. 10, 1996

[54] BI-DIRECTIONAL WIPER FOR INK JET PRINTHEAD AND METHOD OF OPERATION

[75] Inventor: James P. Kearns, Corvallis, Oreg.

[73] Assignee: Hewlett-Packard Company, Palo Alto, Calif.

[21] Appl. No.: 396,811

[22] Filed: Mar. 1, 1995

[51] Int. Cl.[6] ..... B41J 2/165

[52] U.S. Cl. ..... 347/33; 15/250.48; 15/250.452

[58] Field of Search ..... 347/33; 15/97.1, 15/103, 118, 256.5, 250.202, 250.361, 250.451, 250.452, 250.453, 250.44, 250.48

[56] References Cited

U.S. PATENT DOCUMENTS

| | | | |
|---|---|---|---|
| 2,939,165 | 6/1960 | Quinlan et al. | 15/250.48 |
| 3,566,432 | 3/1971 | Ryck | 15/250.48 |
| 4,112,435 | 9/1978 | Kattner et al. | 347/33 |
| 4,371,881 | 2/1983 | Bork et al. | 347/29 |
| 4,829,318 | 5/1989 | Racicot et al. | 347/33 |
| 4,853,717 | 8/1989 | Harmon et al. | 347/29 |
| 5,081,472 | 1/1992 | Fisher | 347/33 |
| 5,094,554 | 3/1992 | Hurd et al. | 400/59 |
| 5,103,244 | 4/1992 | Gast et al. | 347/33 |
| 5,115,250 | 5/1992 | Harmon et al. | 347/33 |
| 5,146,243 | 9/1992 | English et al. | 347/29 |
| 5,155,497 | 10/1992 | Martin et al. | 347/33 |
| 5,300,958 | 4/1994 | Burke et al. | 347/28 |
| 5,325,111 | 6/1994 | Dietl | 347/30 |

FOREIGN PATENT DOCUMENTS

| | | | |
|---|---|---|---|
| 0071254 | 2/1983 | European Pat. Off. | B41J 3/04 |
| 0589604 | 3/1994 | European Pat. Off. | B41J 2/165 |
| 3528926 | 8/1985 | Germany | B41J 3/04 |
| 59-14962 | 1/1984 | Japan | 347/33 |
| 3-253347 | 11/1991 | Japan | 347/33 |
| 2069326 | 8/1981 | United Kingdom | 15/250.48 |

*Primary Examiner*—John E. Barlow, Jr.

[57] ABSTRACT

A wiper having a flexible, elongated body that is supported by a rigid frame at spaced-apart support points on the body. A wiper nib is connected to the body at an intermediate point between the support points. The nib and body may be integrally formed as a single elastomeric member, and the body may be curved to form an elongated arc to generate compressive strain in the body in response to deflection of the nib in a lateral direction.

20 Claims, 1 Drawing Sheet

BI-DIRECTIONAL WIPER FOR INK JET PRINTHEAD AND METHOD OF OPERATION

FIELD OF THE INVENTION

This invention relates to ink jet printers and print heads, and more particularly devices for cleaning of print heads.

BACKGROUND AND SUMMARY OF THE INVENTION

The orifice plate of a print head in an ink jet primer tends to collect debris such as paper dust during the printing process. The debris adheres to the orifice plate due to the occasional accumulation of ink droplets or an electrostatic charge. If left dirty, the accretion of debris and ink may impair printing quality by blocking or deflecting the passage of ink droplets during priming.

Some existing printers remove such debris with wipers that function as squeegees. A typical wiper has a cantilevered elastomeric blade extending perpendicularly to the orifice plate. As the plate slides past the blade, the blade is deflected to contact the plate at an "angle of attack" that varies with the spacing between the wiper and the plate. Variations in the angle of attack result in an undesirable variation in wiping effectiveness. For instance, reduced spacing causes the blade to bend excessively to a zero angle of attack in which a face of the blade presses against the plate and the desired scraping effect of the blade edge is lost. While an oblique angle of attack is desired, the normal force of the wiper varies too greatly with small spacing variations, necessitating a lesser contact angle to maintain normal forces within acceptable ranges as the spacing varies within tolerances. In addition, even with a tolerable range of variation of the normal force, a cantilevered wiper is prone to non linearity of response. That is, it has a spring constant that varies over the range of motion; beyond a certain displacement, no more force may be generated.

Existing cantilevered blade wipers rely on the softness of the material to provide flexing and a spring force. The geometry of a cantilever requires that a relatively soft material be used to provide adequate flexing. This forces the use of materials that wear more readily at the contact edge, and which are less effective at dislodging tenacious debris. Also, such existing wipers are not useful for bidirectional wiping, because the blade is susceptible to buckling in the opposite direction.

These disadvantages are overcome by providing a wiper having a flexible, elongated body that is supported by a rigid frame at spaced-apart support points on the body. A wiper nib is connected to the body at an intermediate point between the support points. The nib and body may be integrally formed as a single elastomeric member, and the body may be curved to form an elongated arc to generate compressive strain in the body in response to deflection of the tip in a lateral direction.

DETAILED DESCRIPTION OF A PREFERRED EMBODIMENT

Figure 1:
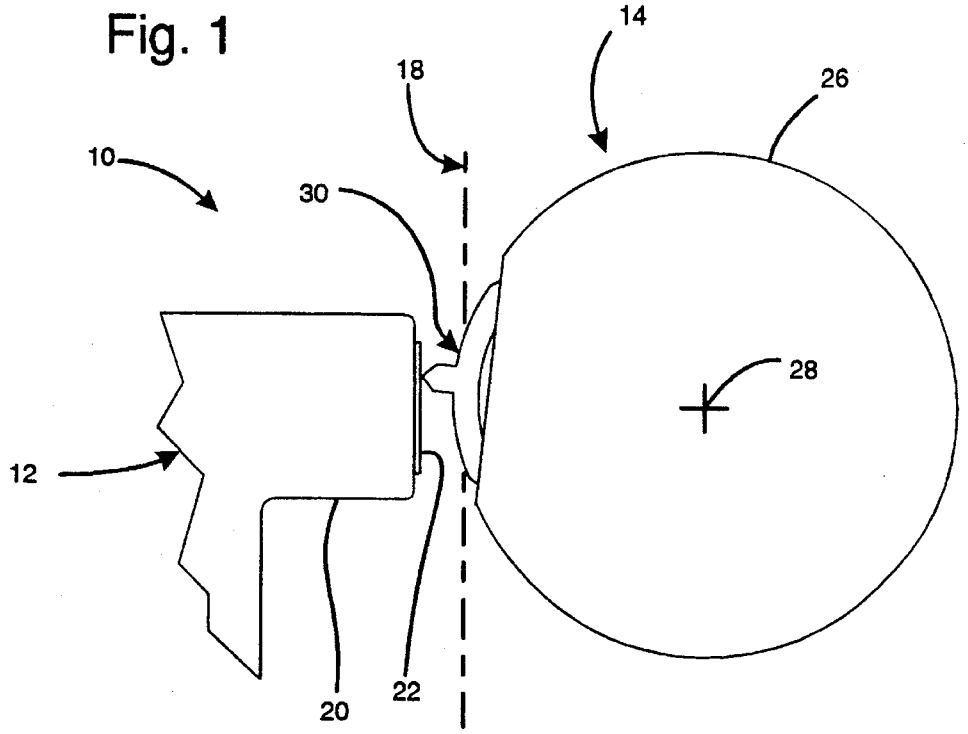
FIG. 1 is a side view of a preferred embodiment of the invention.

FIG. 1 shows a portion of an ink jet printer 10 including an ink cartridge 12 and a wiper assembly 14. The printer has a frame (not shown) to which all printer components are connected, with all moving components moving relative to the frame. Although the apparatus is shown in a particular orientation, it may function effectively in any orientation.

The ink cartridge 12 is positioned to the left of a paper plane 18, and includes a rightwardly extending nose 20 with an ink jet orifice plate 22 on the end of the nose. The orifice plate is parallel to and closely spaced apart from the paper plane 18. For printing, the ink cartridge moves in a linear path or scan axis that is parallel to the paper plane 18 and is perpendicular to the page on which FIG. 1 is printed.

The wiper assembly 14 is positioned opposite the orifice plate 22, and is substantially located on the opposite side of the paper plane from the ink cartridge 12. The wiper assembly includes a wiper frame 26 that is mounted to the printer frame for rotation about a fixed wiper axis 28 that is parallel to the scan axis. The wiper axis 28 is spaced apart from the orifice plate 22 by a selected distance, and all rigid elements on the frame 26 are positioned to extend radially from the axis by a radius less than the selected distance. This prevents any portion of the frame 26 from contacting the orifice plate 22 as the frame rotates about the axis 28.

Figure 2:
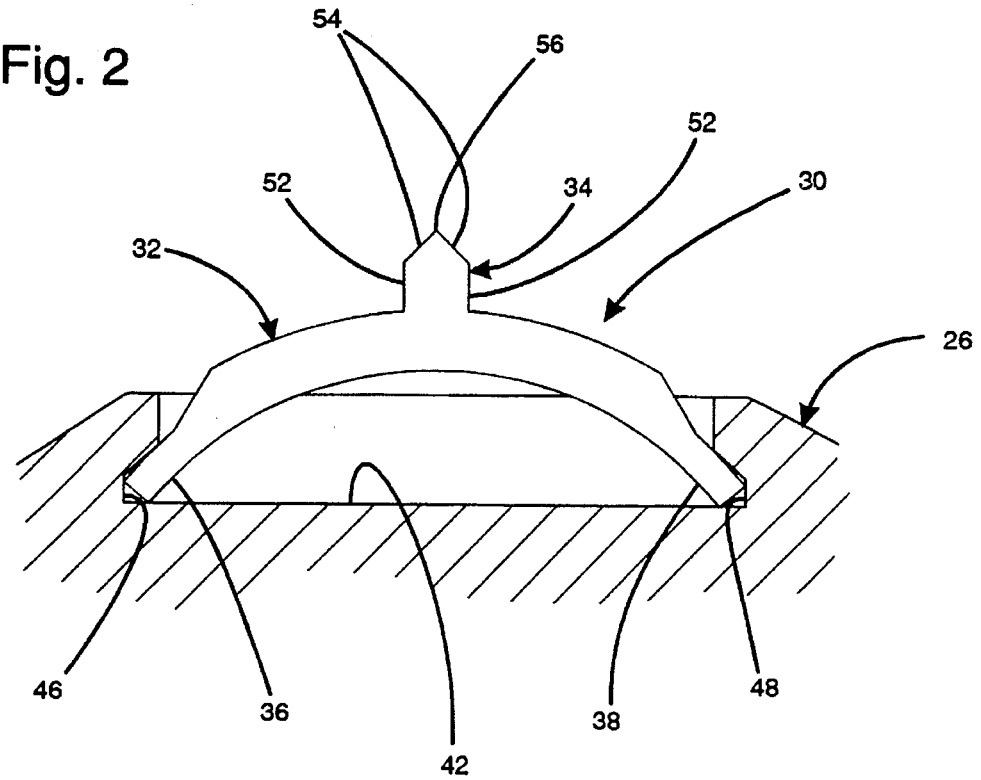
FIG. 2 is an enlarged sectional side view of the embodiment of FIG. 1.

An elastomeric wiper element 30 is connected to the frame 26, so that a portion extends to a radius from the axis sufficient for it to contact the orifice plate 22 as the wiper assembly 14 rotates. As shown in FIG. 2, the wiper element 30 is molded as an integral unit. It includes an elongated arc-shaped body 32 having a rectangular cross section, and a wiper nib 34 attached to the midpoint of the body and extending radially away from the axis 28. The elongated body 32 has tapered opposite ends 36, 38 that are received in an elongated cavity 42 defined in the wiper frame 26. The ends 36, 38 serve as attachment points in contact with the wiper frame 26.

The cavity 42 has a limited width and length to closely receive the wiper element 30, and a limited depth so that the entire wiper nib 34 extends out of the cavity. The opposite ends of the cavity include undercut tapered pockets 46, 48. The ends 36, 38 of the wiper element are snugly received in the respective pockets, with the undercut preventing the wiper member from falling out of the cavity as the wiper assembly is fully rotated. The distance between the ends of the pockets is slightly less than the distance between the ends of the wiper member. Consequently, the wiper member must be slightly flexed for installation and retention. The outwardly biased ends prevent the wiper member from wobbling within the frame.

The wiper nib 34 extends perpendicularly from the mid point of the convex side of the wiper body. It has the shape of a chisel point, with parallel sides 52 extending perpendicularly from the body 32, and end surfaces 54 disposed from the sides 52 at a 45 degree angle to meet at a right angle to form a point 56. During the wiping process, the point 56 sweeps across the orifice plate 22. Many alternative tip geometries may be effectively substituted.

OPERATION

When it is necessary to wipe the orifice plate of debris, such as when a sheet is about to be printed, the ink cartridge 12 is translated to a terminal end position in its path, beyond the edge of the region in the paper plane 18 that a sheet might normally occupy during printing. The wiper assembly is rotated from a rest position in which the wiper point is away from the orifice plate, through a range of motion so that the point smoothly wipes across the orifice plate. If additional wiping is desired, the assembly may be rotated in the opposite direction after the point has cleared the orifice plate to wipe in the opposite direction for more thorough wiping. Otherwise, the assembly may continue rotating until the rest position is reached. The symmetry of the wiper assembly, with the equal support from the opposite ends of the wiper element 30, makes bi-directional wiping possible.

During wiping, the point 56 first encounters the edge of the nose, with the slope of an end surface 54 providing a camming effect to force the nib 34 radially inward toward the axis. This generated the desired normal force between the point and the orifice plate that provides thorough cleaning. As the nib 34 is forced radially inward, the arch shape distributes the force compressively through the length of the body 32 to bias the ends 36, 38 outwardly against the cavity ends 46, 48. In an elastomer, the strain is a very linear function of an applied compressive force, unlike the non linear response to bending forces causing large deflections. Although not preferred, a symmetrical wiper according to the present invention may use a straight wiper body that is deflected only by bending without compression to provide many advantages of the invention. In either case, a symmetrical wiper provides predictable radial or axial deflection without appreciable lateral bending.

DETAILS

In the preferred embodiment, the wiper member 30 is formed a single elastomer such as any rubber, silicone, neoprene, urethane, thermoplastic elastomer or other elastomer having a nib hardness of about 70 Shore-A durometer to avoid excessive wear. The hardness should be at least about 45 Shore A, and may be as hard as values in the Shore D scale. Alternatively, the body may be formed of any resilient material, with only an elastomeric nib. The wiper element 30 has a length of 10 mm, and a uniform overall width of 8 min. The body 32 has a thickness of 1.5 mm over most of its length, and tapers to a thickness of 1 mm at its ends. The nib 34 has a thickness of 1.8 mm between the sides 52, and the point extends to a length of 2.5 mm from the convex outer surface of the body 32. To prevent excessive lateral deflection of the nib during wiping the ratio of the nib length to its thickness should be less than about 1.5:1. In the relaxed state, the point 56 extends to a radius of about 20 mm from the wiper axis 28. The orifice plate 22 is spaced about 17.5 mm from the wiper axis 28, creating a maximum interference of 2.5 mm between the point 56 and the plate 22.

The invention is not limited to the illustrated embodiment. The wiper assembly may alternatively move linearly instead of rotationally. Such linear motion would be in the vertical direction given the orientation of FIG. 1, and would provide an even more constant angle of attack with which the nib contacts the orifice plate. Variations in the angle of attack in the illustrated embodiment are minimal because the orifice plate 22 subtends a small angle as measured from the axis 28. Also, the wiper element may be formed with a straight body 32 that is flexed to form the preferred curved shape when installed in the frame.

What is claimed is:

1. A wiper assembly operable in conjunction with an ink jet printer having an ink cartridge with an orifice plate surface susceptible to accumulation of debris, the wiper assembly comprising:

a wiper frame movable through a selected range of motion;

a resilient elongated wiper body connected to the wiper frame and contacting the frame at two attachment points on the body, the attachment points being widely spaced apart along the body such that the body may flex between the points; and a wiper nib connected to the wiper body at an intermediate position between the attachment points, the nib having a free end portion extending away from the frame such that the free end portion may contact and wipe an adjacent orifice plate when the wiper frame is moved within the selected range of motion of the wiper frame, wherein the resilient body allows for axial deflection of the nib in a direction substantially perpendicular to a line connecting the attachment points.

2. The apparatus of claim 1 wherein the nib is formed of an elastomeric material.

3. The apparatus of claim 1 wherein the wiper body and nib are integrally formed of a single material.

4. The apparatus of claim 4 wherein the wiper body and nib are integrally formed of an elastomeric material.

5. The apparatus of claim 1 wherein the wiper frame is formed of a rigid material.

6. The apparatus of claim 1 wherein the wiper frame is rotatable with respect to the printer frame.

7. The apparatus of claim 1 wherein the wiper frame is movable linearly along a line parallel to the orifice plate.

8. The apparatus of claim 1 wherein the wiper body is arc shaped.

9. The apparatus of claim 1 wherein the wiper nib is positioned mid way between the attachment points of the wiper body.

10. The apparatus of claim 1 wherein the wiper nib has a thickness less than 1.5 times the distance by which it extends from the wiper body.

11. The apparatus of claim 1 wherein the attachment points are spaced apart by a distance in the range of 5 and 25 mm.

12. An ink jet printer comprising:

a printer frame;

an ink cartridge connected to the printer frame for linear movement with respect to the frame, the ink cartridge having an orifice plate surface susceptible to accumulation of debris;

a wiper frame connected to the printer frame for relative movement with respect to the printer frame;

a resilient elongated wiper body connected to the wiper frame and contacting the frame at two attachment points on the body, the attachment points being spaced apart along the body such that the body may flex between the points; and a wiper nib connected to the wiper body at an intermediate position between the attachment points, the nib having a free end portion extending to contact and wipe the orifice plate when the wiper frame is moved through a selected range of motion of the wiper frame.

13. The apparatus of claim 12 wherein the nib is formed of an elastomeric material.

14. The apparatus of claim 12 wherein the wiper body and nib are integrally formed of a single material.

15. The apparatus of claim 14 wherein the wiper body and nib are integrally formed of an elastomeric material.

16. The apparatus of claim 12 wherein the wiper frame is rotatable with respect to the printer frame.

17. The apparatus of claim 12 wherein the wiper body is arc shaped.

18. A method of wiping the surface of an ink jet printing mechanism comprising the steps:

providing a flexible wiper element having a central nib connected between spaced apart attachment points on the element;

moving the wiper element through a path to contact the nib to the surface;

after contacting the nib to the surface, moving the nib across the surface;

while moving the nib across the surface, biasing the nib to generate a compressive force against the surface.

19. The method of claim 18 wherein the step of biasing the nib comprises generating a compressive stress in the wiper element between the attachment points.

20. The method of claim 18 wherein the step of moving the wiper element comprises rotating the element about an axis of rotation, and wherein the step of biasing the nib comprises biasing the nib toward the axis.

* * * * *